US007397388B2

(12) United States Patent
Huang et al.

(10) Patent No.: US 7,397,388 B2
(45) Date of Patent: Jul. 8, 2008

(54) BOREHOLD TELEMETRY SYSTEM

(75) Inventors: Songming Huang, Cambridgeshire (GB); Franck Monmont, Caldecote (GB); Robert Tennent, Cambridge (GB); Matthew Hackworth, Bartlesville, OK (US); Craig Johnson, Montgomery, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 611 days.

(21) Appl. No.: 11/017,631

(22) Filed: Dec. 20, 2004

(65) Prior Publication Data

US 2005/0168349 A1 Aug. 4, 2005

Related U.S. Application Data

(63) Continuation-in-part of application No. PCT/GB2004/001281, filed on Mar. 24, 2004.

(51) Int. Cl.
*G01V 3/00* (2006.01)

(52) U.S. Cl. ..... 340/853.3; 341/854.3; 341/855.4; 367/81; 367/83; 166/373; 166/375

(58) Field of Classification Search ..... 340/853.3, 340/854.3, 855.4; 367/81, 83; 73/152.31, 73/152.59; 166/363, 373, 375
See application file for complete search history.

(56) References Cited

U.S. PATENT DOCUMENTS 3,309,656 A 3/1967 Godbey
3,659,259 A 4/1972 Chaney, Jr. et al.
3,742,443 A 6/1973 Foster et al.
3,747,059 A 7/1973 Garcia
3,792,428 A * 2/1974 Harrell et al. ..... 367/85
3,863,203 A * 1/1975 Patton et al. ..... 367/85
3,906,434 A 9/1975 Lamel
3,964,556 A 6/1976 Gearhart et al.
5,275,041 A * 1/1994 Poulsen ..... 73/152.31
5,283,768 A 2/1994 Rorden
5,517,854 A * 5/1996 Plumb et al. ..... 73/152.59
5,839,508 A 11/1998 Tubel et al.
5,995,449 A * 11/1999 Green et al. ..... 367/83
6,182,764 B1 * 2/2001 Vaynshteyn ..... 166/373
6,208,586 B1 * 3/2001 Rorden et al. ..... 367/35
6,236,620 B1 * 5/2001 Schultz et al. ..... 367/82
6,442,105 B1 8/2002 Tubel et al.
6,536,529 B1 * 3/2003 Kerr et al. ..... 166/375
6,717,283 B2 4/2004 Skinner et al.

FOREIGN PATENT DOCUMENTS

GB 2399921 A 9/2004

* cited by examiner

*Primary Examiner*—Timothy Edwards, Jr.
(74) *Attorney, Agent, or Firm*—Bryan P. Galloway; Daryl R. Wright; Trop, Pruner & Hu, P.C.

(57) ABSTRACT

A system that is usable with a subterranean well includes an assembly and a telemetry tool. The system includes an assembly that performs a downhole measurement. The system also includes a downhole telemetry tool to modulate a carrier stimulus that is communicated through a downhole fluid to communicate the downhole measurement uphole.

51 Claims, 15 Drawing Sheets

BOREHOLD TELEMETRY SYSTEM

This application is a continuation-in-part of International Application PCT/GB2004/001281, with an international filing date of Mar. 24, 2004, which claims priority to Great Britain Application No. 0306929.1, filed on Mar. 26, 2003.

BACKGROUND

The present invention generally relates to a borehole telemetry system.

One of the more difficult problems associated with any borehole is to communicate measured data between one or more locations down a borehole and the surface, or between down-hole locations themselves. For example, communication is desired by the oil industry to retrieve, at the surface, data generated down-hole during operations such as perforating, fracturing, and drill stem or well testing; and during production operations such as reservoir evaluation testing, pressure and temperature monitoring. Communication is also desired to transmit intelligence from the surface to down-hole tools or instruments to effect, control or modify operations or parameters.

Accurate and reliable down-hole communication is particularly important when complex data comprising a set of measurements or instructions is to be communicated, i.e., when more than a single measurement or a simple trigger signal has to be communicated. For the transmission of complex data it is often desirable to communicate encoded digital signals.

One approach which has been widely considered for borehole communication is to use a direct wire connection between the surface and the down-hole location(s). Communication then can be made via electrical signal through the wire. While much effort has been spent on "wireline" communication, its inherent high telemetry rate is not always needed and very often does not justify its high cost.

Wireless communication systems have also been developed for purposes of communicating data between the surface of the well and a downhole tool. These techniques include, for example, communicating commands downhole via pressure pulses and fluid or acoustic communication, for example. A difficulty with some of these arrangements is that the communication is limited in scope and/or may require a relatively large amount of downhole power.

Thus, there is a continuing need for a borehole telemetry system that addresses one or more of the problems that are stated above as well as possibly addresses one or more problems that are not stated forth above.

SUMMARY

In an embodiment of the invention, a system that is usable with a subterranean well includes an assembly and a downhole telemetry tool. The assembly performs a downhole measurement. The telemetry tool modulates a carrier stimulus communicated through a well fluid to communicate the downhole measurement uphole.

Advantages and other features of the invention will become apparent from the following description, drawing and claims.

DETAILED DESCRIPTION

Figure 1:
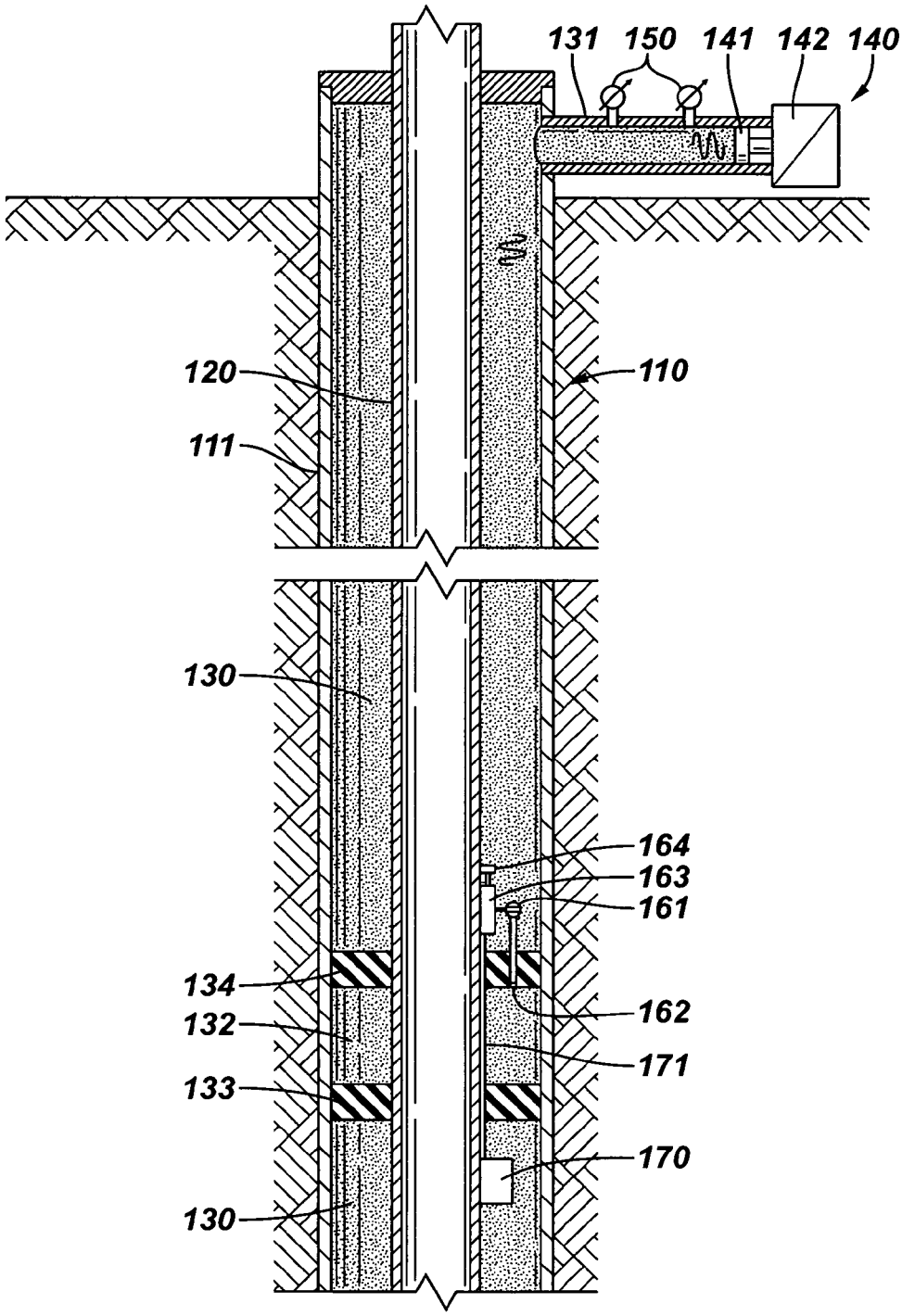
FIGS. 1, 2, 3A and 7A are schematic diagrams of borehole telemetry systems according to different embodiments of the invention.

Referring first to the schematic drawing of FIG. 1, there is shown a cross-section through a cased wellbore 110 with a work string 120 suspended therein. Between the work string 120 and the casing 111 there is an annulus 130. During telemetry operations the annulus 130 is filled with a low-viscosity liquid such as water. A surface pipe 131 extends the annulus to a pump system 140 located at the surface. The pump unit includes a main pump for the purpose of filing the annulus and a second device that is used as an acoustic wave source. The wave source device includes a piston 141 within the pipe 131 and a drive unit 142. Further elements located at the surface are sensors 150 that monitor acoustic or pressure waveforms within the pipe 131 and thus acoustic waves traveling within the liquid-filled column formed by the annulus 130 and surface pipe 131.

At a down-hole location there is shown a liquid filled volume formed by a section 132 of the annulus 130 separated from the remaining annulus by a lower packer 133 and an upper packer 134. The packers 133, 134 effectively terminate the liquid filled column formed by the annulus 130 and surface pipe 131. Acoustic waves generated by the source 140 are reflected by the upper packer 134.

The modulator of the present example is implemented as a stop valve 161 that opens or blocks the access to the volume 132 via a tube 162 that penetrates the upper packer 134. The valve 161 is operated by a telemetry unit 163 that switches the valve from an open to a closed state and vice versa.

The telemetry unit 163 in turn is connected to a data acquisition unit or measurement sub 170. The unit 170 receives measurements from various sensors (not shown) and encodes those measurements into digital data for transmission. Via the telemetry unit 163 these data are transformed into control signals for the valve 161.

In operation, the motion of the piston 141 at a selected frequency generates a pressure wave that propagates through the annulus 130 in the down-hole direction. After reaching the closed end of the annulus, this wave is reflected back with a phase shift added by the down-hole data modulator and propagates towards the surface receivers 150.

The data modulator can be seen as consisting of three parts: firstly a zero-phase-shift reflector, which is the solid body of the upper packer 134 sealing the annulus and designed to have a large acoustic impedance compared with that of the liquid filling the annulus, secondly a 180-degree phase shifting (or phase-inverting) reflector, which is formed when valve 161 is opened and pressure waves are allowed to pass through the tube 162 between the isolated volume 132 and the annulus 130 and thirdly the phase switching control device 162, 163 that enables one of the reflectors (and disables the other) according to the binary digit of the encoded data.

In the example the phase-shifting reflector is implemented as a Helmholtz resonator, with a fluid-filled volume 132 providing the acoustic compliance, C, and the inlet tube 162 connecting the annulus and the fluid-filled volume providing an inertance, M, where $$C=V/\rho c^2 \quad [1]$$

and $$M=\rho L/a \quad [2]$$

where V is the fluid filled volume 132, ρ and c are the density and sound velocity of the filling fluid, respectively, and L and a are the effective length and the cross-sectional area of the inlet tube 162, respectively. The resonance frequency of the Helmholtz resonator is then given by:

$$\omega_0=1/(MC)^{0.5}=c(a/(LV)^{0.5} \quad [3]$$

When the source frequency equals $\omega_0$, the resonator presents its lowest impedance at the down-hole end of the annulus.

When the resonator is enabled, i.e., when the valve 161 is opened, its low impedance is in parallel with the high impedance provided by the upper packer 134 and the reflected pressure wave is phase shifted by approximately 180 degrees, and thus effectively inverted compared to the incoming wave.

The value of $\omega_0$ can range from a few Hertz to about 70 Hertz, although for normal applications it is likely to be chosen between 10 to 40 Hz.

The basic function of the phase switching control device, shown as units 163 and 161 in FIG. 1, is to enable and disable the Helmholtz resonator. When enabled, the acoustic impedance at the down-hole end of the annulus equals that of the resonator, and the reflected wave is phase-inverted. When disabled, the impedance becomes that of the packer, and the reflected wave has no phase change. If one assumes that the inverted phase represents binary digit "1", and no phase shift as digit "0", or vice versa, by controlling the switching device with the binary encoded data, the reflected wave becomes a BPSK (binary phase shift key) modulated wave, carrying data to the surface.

The switching frequency, which determines the data rate (in bits/s), does not have to be the same as the source frequency. For instance for a 24 Hz source (and a 24 Hz resonator), the switching frequency can be 12 Hz or 6 Hz, giving a data rate of 12-bit/s or 6-bit/s.

The down-hole data are gathered by the measurement sub 170. The measurement sub 170 contains various sensors or gauges (pressure, temperature etc.) and is mounted below the lower packer 133 to monitor conditions at a location of interest. The measurement sub may further contain data-encoding units and/or a memory unit that records data for delayed transmission to the surface.

The measured and digitized data are transmitted over a suitable communication link 171 to the telemetry unit 163, which is situated above the packer. This short link can be an electrical or optical cable that traverses the dual packer, either inside the packer or inside the wall of the work string 120. Alternatively it can be implemented as a short distance acoustic link or as a radio frequency electromagnetic wave link with the transmitter and the receiver separated by the packers 133, 134.

The telemetry unit 163 is used to encode the data for transmission, if such encoding has not been performed by the measurement sub 170. It further provides power amplification to the coded signal, through an electrical power amplifier, and electrical to mechanical energy conversion, through an appropriate actuator.

For use as a two-way telemetry system, the telemetry unit also accepts a surface pressure wave signal through a down-hole acoustic receiver 164.

A two-way telemetry system can be applied to alter the operational modes of down-hole devices, such as sampling rate, telemetry data rate during the operation. Other functions unrelated to altering measurement and telemetry modes may include open or close certain down-hole valve or energize a down-hole actuator. The principle of down-hole to surface telemetry (up-link) has already been described in the previous sections. To perform the surface to down-hole down link, the surface source sends out a signal frequency, which is significantly different from the resonance frequency of the Helmholtz resonator and hence outside the up-link signal spectrum and not significantly affected by the down-hole modulator.

For instance, for a 20 Hz resonator, the down-linking frequency may be 39 Hz (in choosing the frequency, the distribution of pump noise frequencies, mainly in the lower frequency region, need to be considered). When the down-hole receiver 164 detects this frequency, the down-hole telemetry unit 163 enters into a down-link mode and the modulator is disabled by blocking the inlet 162 of the resonator. Surface commands may then be sent down by using appropriate modulation coding, for instance, BPSK or FSK on the down-link carrier frequency.

The up-link and down-link may also be performed simultaneously. In such case a second surface source is used. This may be achieved by driving the same physical device 140 with two harmonic waveforms, one up-link carrier and one down-link wave, if such device has sufficient dynamic performance. In such parallel transmissions, the frequency spectra of up and down going signals should be clearly separated in the frequency domain.

The above described elements of the novel telemetry system may be improved or adapted in various ways to different down hole operations.

In the example of FIG. 1, the volume 132 of the Helmholtz resonator is formed by inflating the lower main packer 133 and the upper reflecting packer 134, and is filled with the same fluid as that present in the column 130. However as an alternative the Helmholtz resonator may be implemented as a part of dedicated pipe section or sub.

Figure 2:
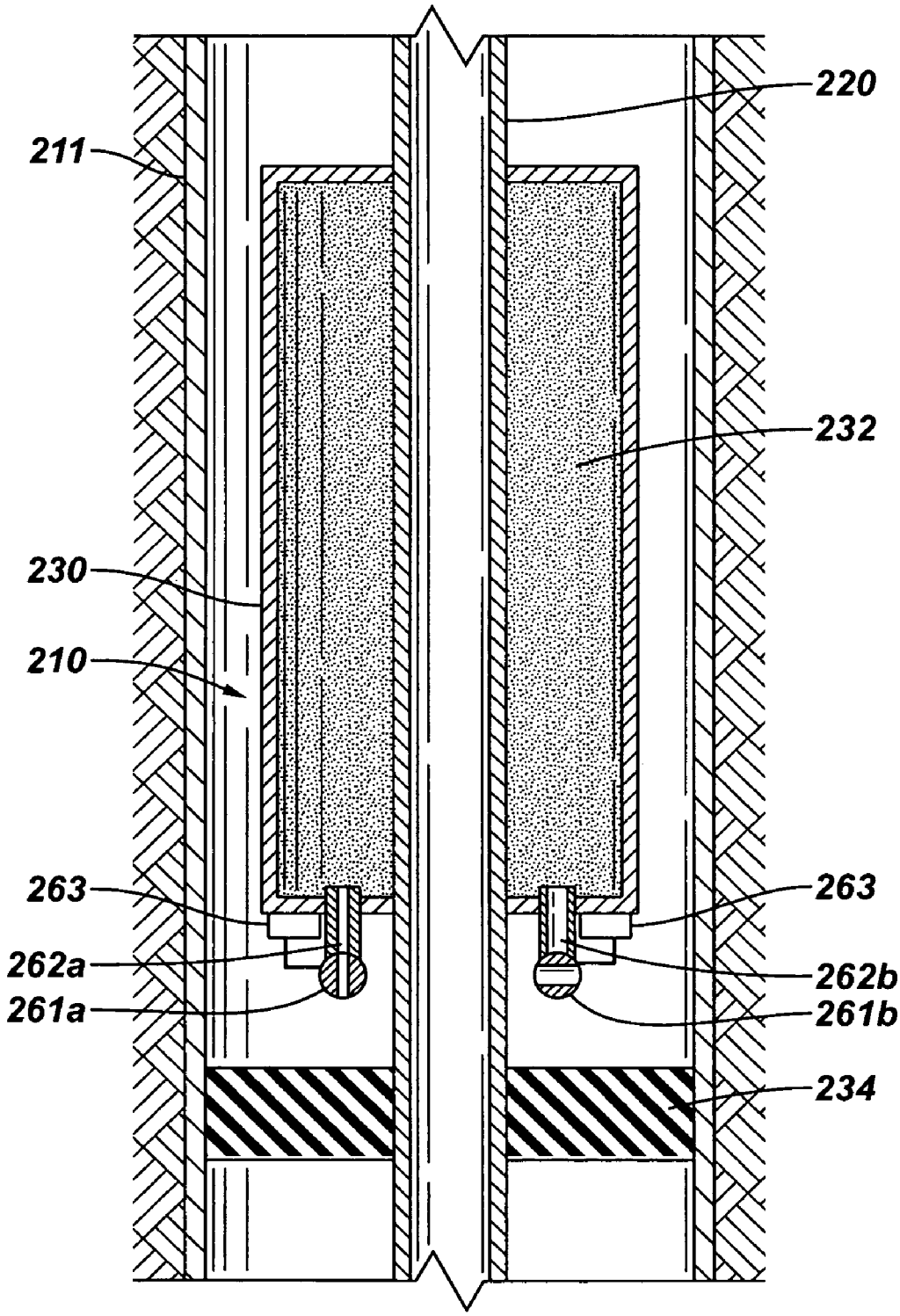

For example in FIG. 2, the phase-shifting device forms part of a sub 210 to be included into a work string 220 or the like. The volume 232 of the Helmholtz resonator is enclosed between a section of the work string 220 and a cylindrical enclosure 230 surrounding it. Tubes 262*a,b* of different lengths and/or diameter provide openings to the wellbore. Valves 261*a,b* open or close these openings in response to the control signals of a telemetry unit 263. A packer 234 reflects the incoming waves with phase shifts that depend on the state of the valves 261*a,b*.

The volume 232 and the inlet tubes 262*a,b* are shown pre-filled with a liquid, which may be water, silicone oil, or any other suitable low-viscosity liquid. Appropriate dimensions for inlet tubes 262 and the volume 232 can be selected in accordance with equations [1]-[3] to suit different resonance frequency requirements. With the choice of different tubes 262*a,b*, the device can be operated at an equivalent number of different carrier wave frequencies.

In the following example the novel telemetry system is implemented as a coiled tubing unit deployable from the surface. Coiled tubing is an established technique for well intervention and other operations. In coiled tubing a reeled continuous pipe is lowered into the well. In such a system the acoustic channel is created by filling the coiled tubing with a suitable liquid. Obviously the advantage of such a system is its independence from the specific well design, in particular from the existence or non-existence of a liquid filled annulus for use as an acoustic channel.

Figure 3A:
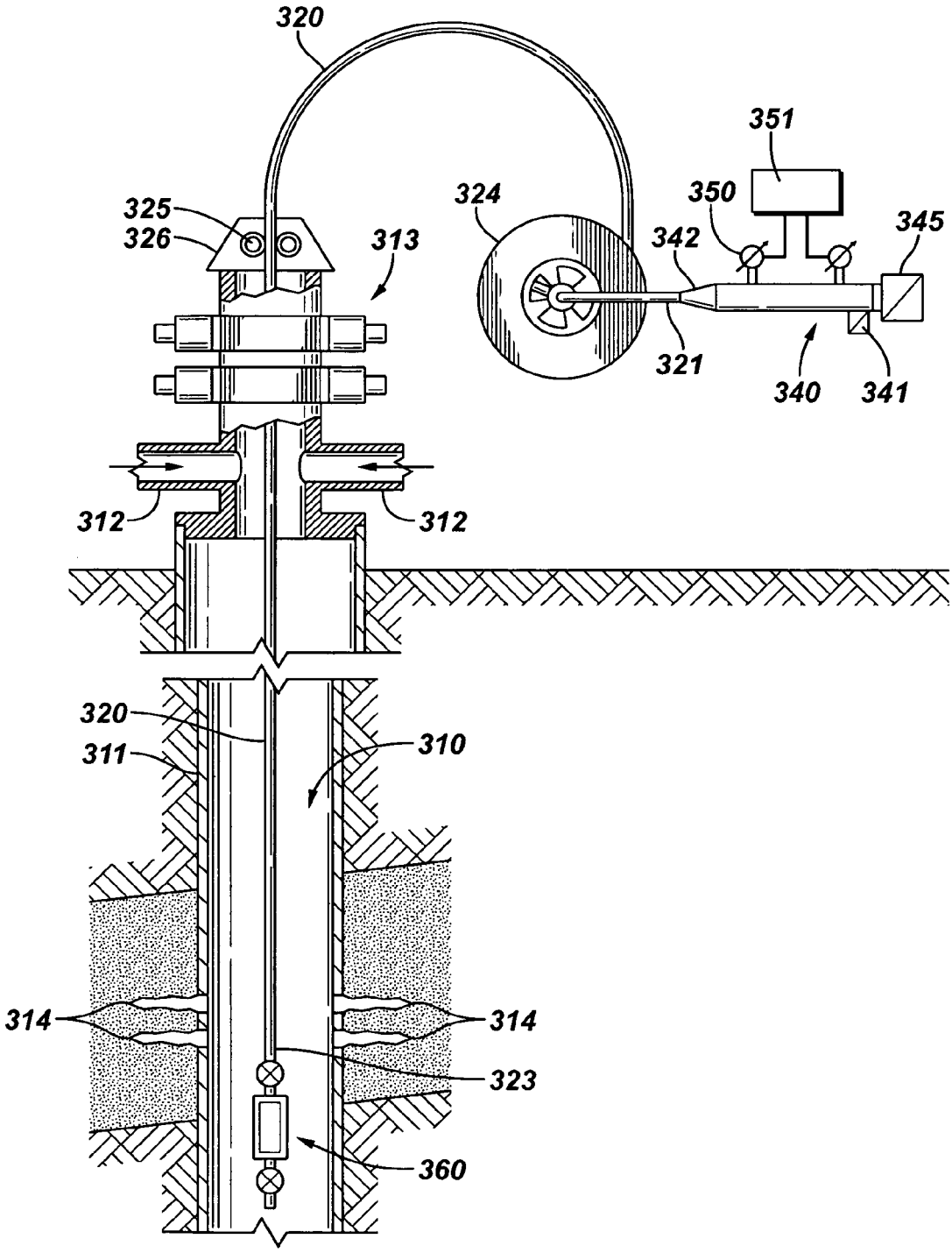

A first variant of this embodiment is shown in FIG. 3. In FIG. 3A, there is shown a borehole 310 surrounded by casing pipes 311. It is assumed that no production tubing has been installed. Illustrating the application of the novel system in a well stimulation operation, pressurized fluid is pumped through a treat line 312 at the well head 313 directly into the cased bore hole 310. The stimulation or fracturing fluid enters the formation through the perforation 314 where the pressure causes cracks allowing improved access to oil bearing formations. During such a stimulation operation it is desirable to monitor locally, i.e., at the location of the perforations, the changing wellbore conditions such as temperature and pressure in real time, so as to enable an operator to control the operation on the basis of improved data.

The telemetry tool includes a surface section 340 preferably attached to the surface end 321 of the coiled tubing 320. The surface section includes an acoustic source unit 341 that generates waves in the liquid filled tubing 320. The acoustic source 341 on surface can be a piston source driven by electro-dynamic means, or even a modified piston pump with small piston displacement in the range of a few millimeters. Two sensors 350 monitor amplitude and/or phase of the acoustic waves traveling through the tubing. A signal processing and decoder unit 351 is used to decode the signal after removing effects of noise and distortion, and to recover the down-hole data. A transition section 342, which has a gradually changing diameter, provides acoustic impedance match between the coiled tubing 320 and the instrumented surface pipe section 340.

Figure 3B:
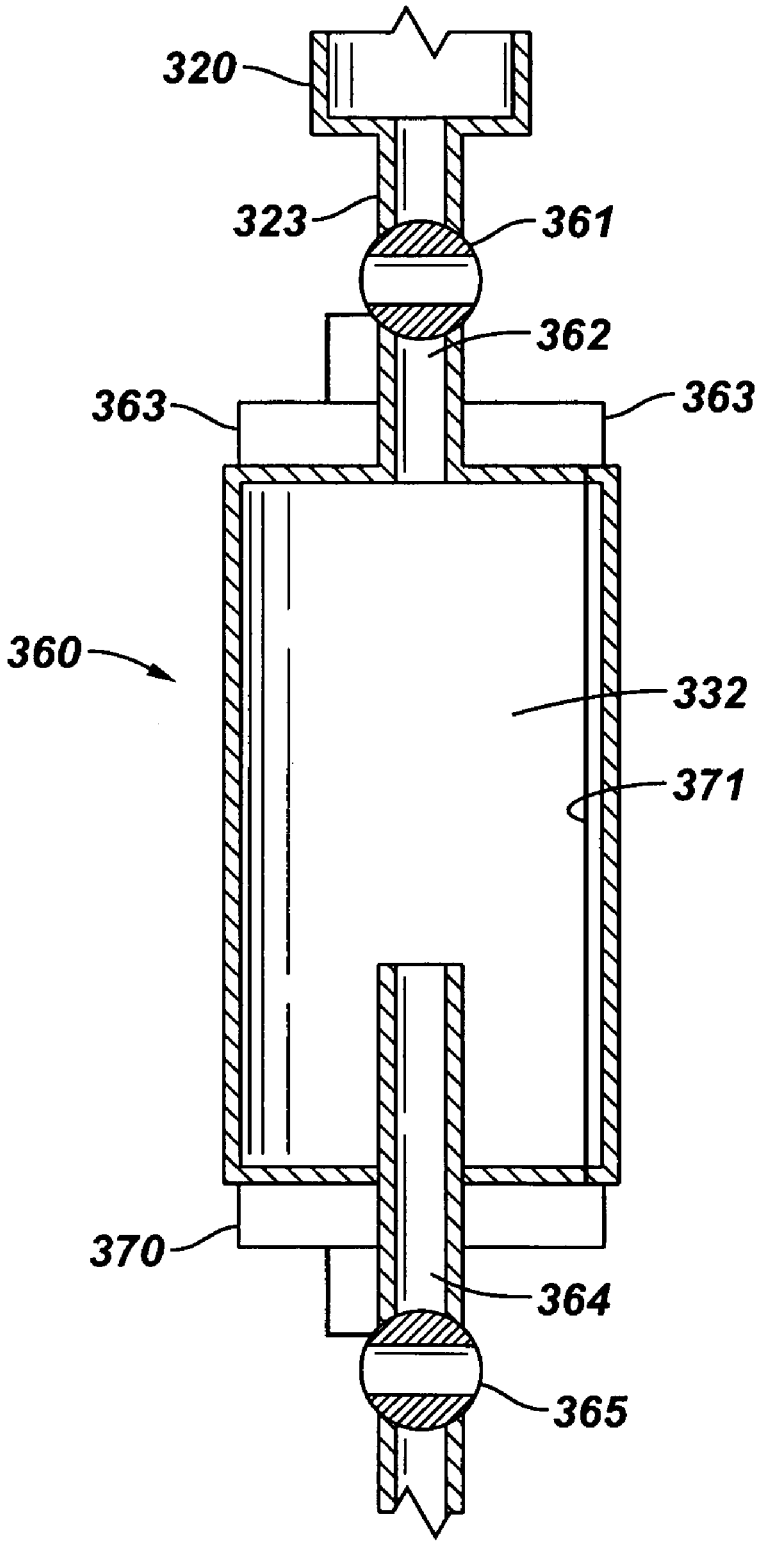
FIG. 3B is a schematic diagram of a resonator of the system of FIG. 3A according to an embodiment of the invention.

At the distant end 323 of the coiled tubing there is attached a monitoring and telemetry sub 360, as shown in detail in FIG. 3B. The sub 360 includes a flow-through tube 364, a lower control valve 365, down-hole gauge and electronics assembly 370, which contains pressure and temperature gauges, data memory, batteries and an additional electronics unit 363 for data acquisition, telemetry and control, a liquid volume or compliance 332, a throat tube 362 and an upper control/modulation valve 361 to perform the phase shifting modulation. The electronic unit 363 contains an electromechanical driver, which drives the control/modulation valve 361. In case of a solenoid valve, the driver is an electrical one that drives the valve via a cable connection. Another cable 371 provides a link between the solenoid valve 365 and the unit 363.

The coiled tubing 320, carrying the down-hole monitoring/telemetry sub 360, is deployed through the well head 313 by using a tubing reel 324, a tubing feeder 325, which is mounted on a support frame 326. Before starting data acquisition and telemetry, both valves 361, 365 are opened, and a low attenuation liquid, e.g. water, is pumped through the coiled tubing 320 by the main pump 345, until the entire coiled tubing and the liquid compliance 332 are filled with water. The lower valve 365 is then shut maintaining a water filled continuous acoustic channel. Ideally the down-hole sub is positioned well below the perforation to avoid high speed and abrasive fluid flow. The liquid compliance (volume) 332 and the throat tube 362 together form a Helmholtz resonator, whose resonance frequency is designed to match the telemetry frequency from the acoustic source 341 on the surface.

The modulation valve 361, when closed, provides a high impedance termination to the acoustic channel, and acoustic wave from the surface is reflected at the valve with little change in its phase. When the valve is open, the Helmholtz resonator provides a low termination to the channel, and the reflected wave has an added phase shift of close to 180°. Therefore the valve controlled by a binary data code will produce an up-going (reflected) wave with a BPSK modulation.

After the stimulation job, the in-well coiled tubing system can be used to clean up the well. This can be done by opening both valves 361, 362 and by pumping an appropriate cleaning fluid through the coiled tubing 320.

Coiled tubing system, as described in FIG. 3, may also be used to establish a telemetry channel through production tubing or other down-hole installations.

In the above examples of the telemetry system the reflected signals monitored on the surface are generally small compared to the carrier wave signal. The reflected and phase-modulated signal, due to the attenuation by the channel, is much weaker than this background interference. Ignoring the losses introduced by the non-ideal characteristics of the down-hole modulator, the amplitude of the signal is given by:

$$A_r = A_s 10^{-2\alpha L/20} \quad [4]$$

where $A_r$ and $A_s$ are the amplitudes of the reflected wave and the source wave, both at the receiver, $\alpha$ is the wave attenuation coefficient in dB/Kft and 2L is the round trip distance from surface to down-hole, and then back to the surface. Assuming a water filled annulus with $\alpha$=1 dB/kft at 25 Hz, then for a well of 10 kft depth, then $A_r$=0.1$A_s$, or the received wave amplitude is attenuated by 20 dB compared with the source wave.

Figure 4A:
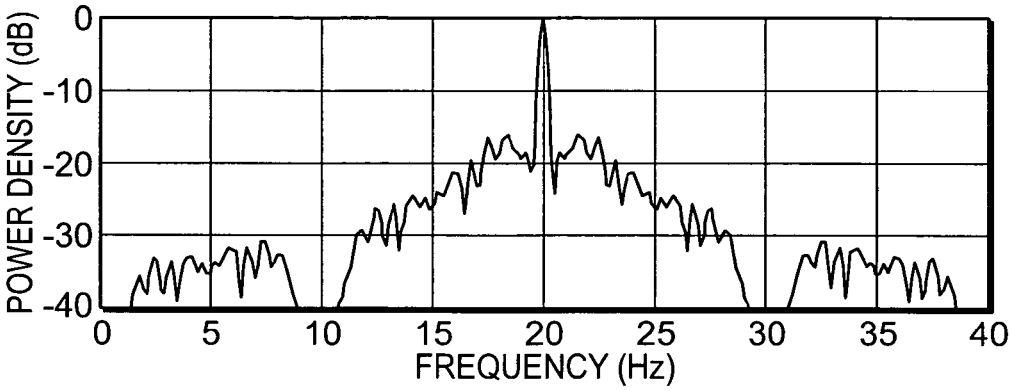
FIGS. 4A and 4B depict power spectra as received at a surface location with and without inference of the source spectrum, respectively according to an embodiment of the invention.
Figure 4B:
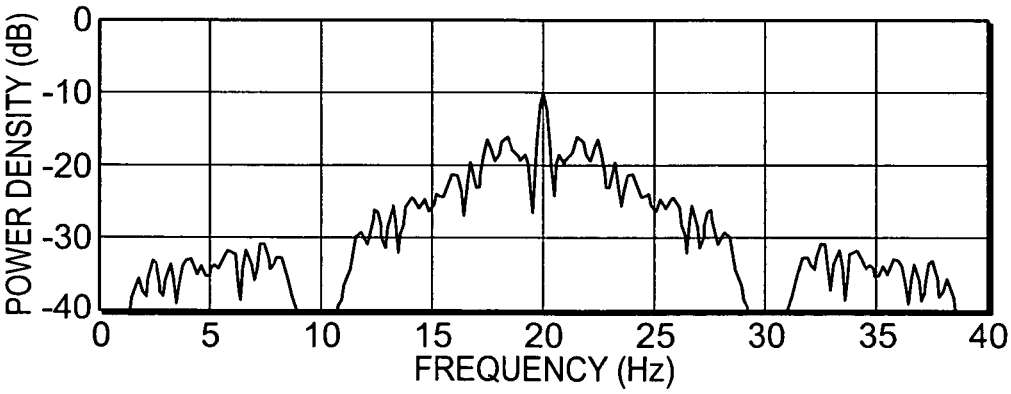

The plot shown in FIG. 4A shows a simulated receiver spectrum for an application with 10 kft water filled annulus. A carrier and resonator frequency of 20 Hz is assumed. The phase modulation is done by randomly switching (at a frequency of 10 Hz) between the reflection coefficient of a down-hole packer (0.9) and that of the Helmholtz resonator (−0.8). The effect is close to a BPSK modulation. The background source wave (narrow band peak at 20 Hz) interferes with the BPSK signal spectrum which is shown in FIG. 4B.

Signal processing can be used to receive the wanted signal in the presence of such a strong sinusoidal tone from the source. A BPSK signal v(t) can be described mathematically as follows $$v(t) = d(t) A_v \cos(\omega_c t) \quad [5]$$

where $d(t) \in \{+1,-1\}$=binary modulation waveform $A_v$=signal amplitude and $\omega_c$=radian frequency of carrier wave.

The source signal at the surface has the form $$s(t)=A_s \cos(\omega_c t) \quad [6]$$

The received signal r(t) at surface is the sum of the source signal and the modulated signal.

$$r(t) = d(t)A_v\cos(\omega_c t) + A_s\cos(\omega_c t) \quad [7]$$

$$= A_s\left[1 + \frac{A_v}{A_s}d(t)\right]\cos(\omega_c t)$$

Equation [7] has the form of an amplitude modulated signal with binary digital data as the modulating waveform. Thus a receiver for amplitude modulation can be used to recover the transmitted data waveform d(t).

Alternatively, since the modulated signal and carrier source waves are traveling in opposite directions, a directional filter, e.g. the differential filter used in mud pulse telemetry reception as shown for example in the U.S. Pat. Nos. 3,742,443 and 3,747,059, could be used to suppress the source tone from the received signal. The data could then be recovered using a BPSK receiver.

It is likely that the modulated received signal will be distorted when it reaches the surface sensors, because of wave reflections at acoustic impedance changes along the annulus channel as well as at the bottom of the hole and the surface. A form of adaptive channel equalization will be required to counteract the effects of the signal distortion.

The down-hole modulator works by changing the reflection coefficient at the bottom of the annulus so as to generate phase changes of 180 degrees, i.e. having a reflection coefficient that varies between +1 and −1. In practice the reflection coefficient $\gamma$ of the down-hole modulator will not produce exactly 180 degree phase changes and thus will be of the form $$\gamma=G_0e^{j\theta_0},\ d(t)=0$$

$$=G_1e^{j\theta_1},\ d(t)=1 \quad [8]$$

where $G_0$ and $G_1$ are the magnitudes of the reflection coefficients for a "0" and "1" respectively. Similarly, $\theta_0$ and $\theta_1$ are the phase of the reflection coefficients.

A more optimum receiver for this type of signal could be developed that estimates the actual phase and amplitude changes from the received waveform and then uses a decision boundary that is the locus of the two points in the received signal constellation to recover the binary data.

Figure 5A:
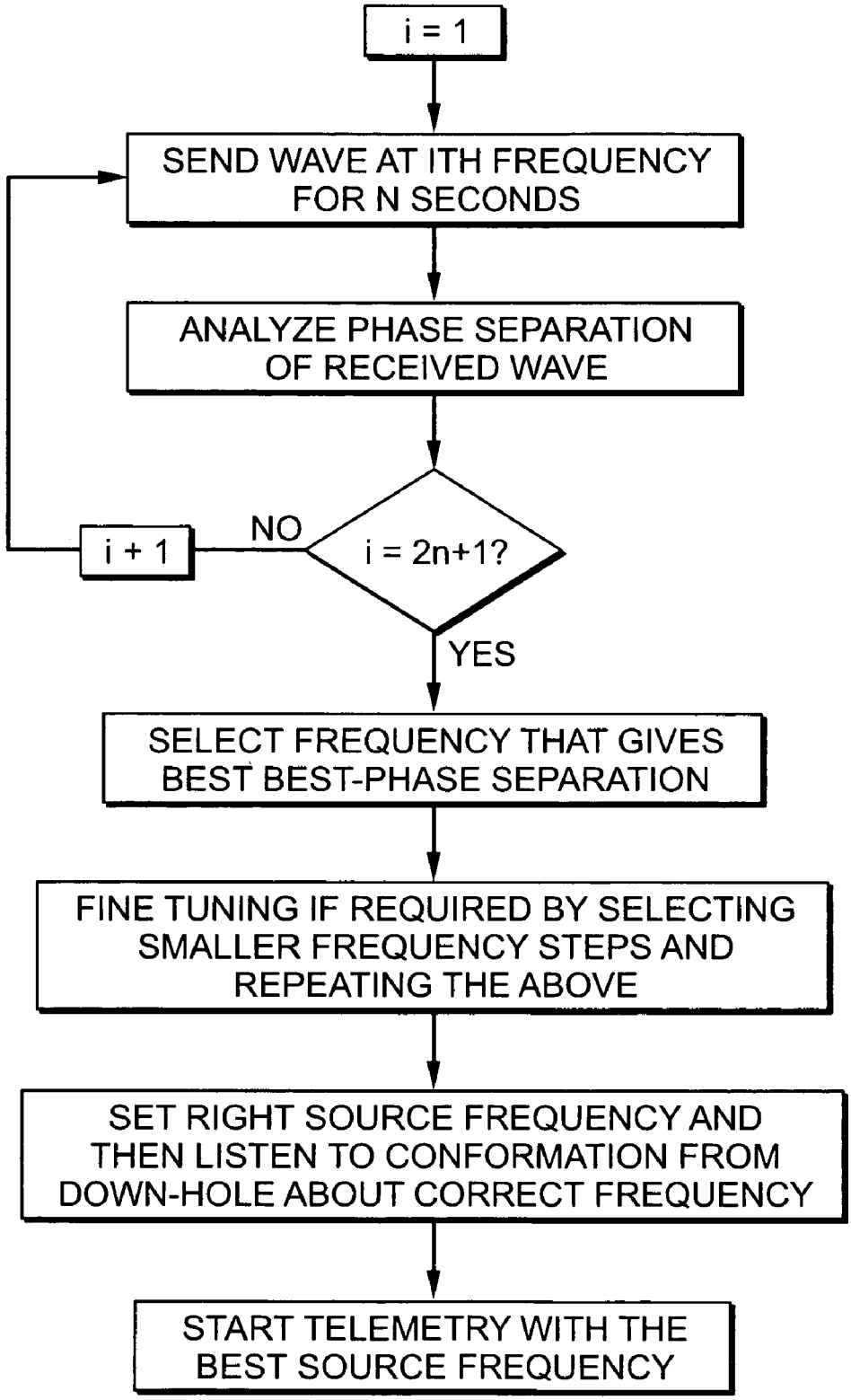
FIGS. 5A and 5B depict a technique to tune a telemetry system according to an embodiment of the invention.
Figure 5B:
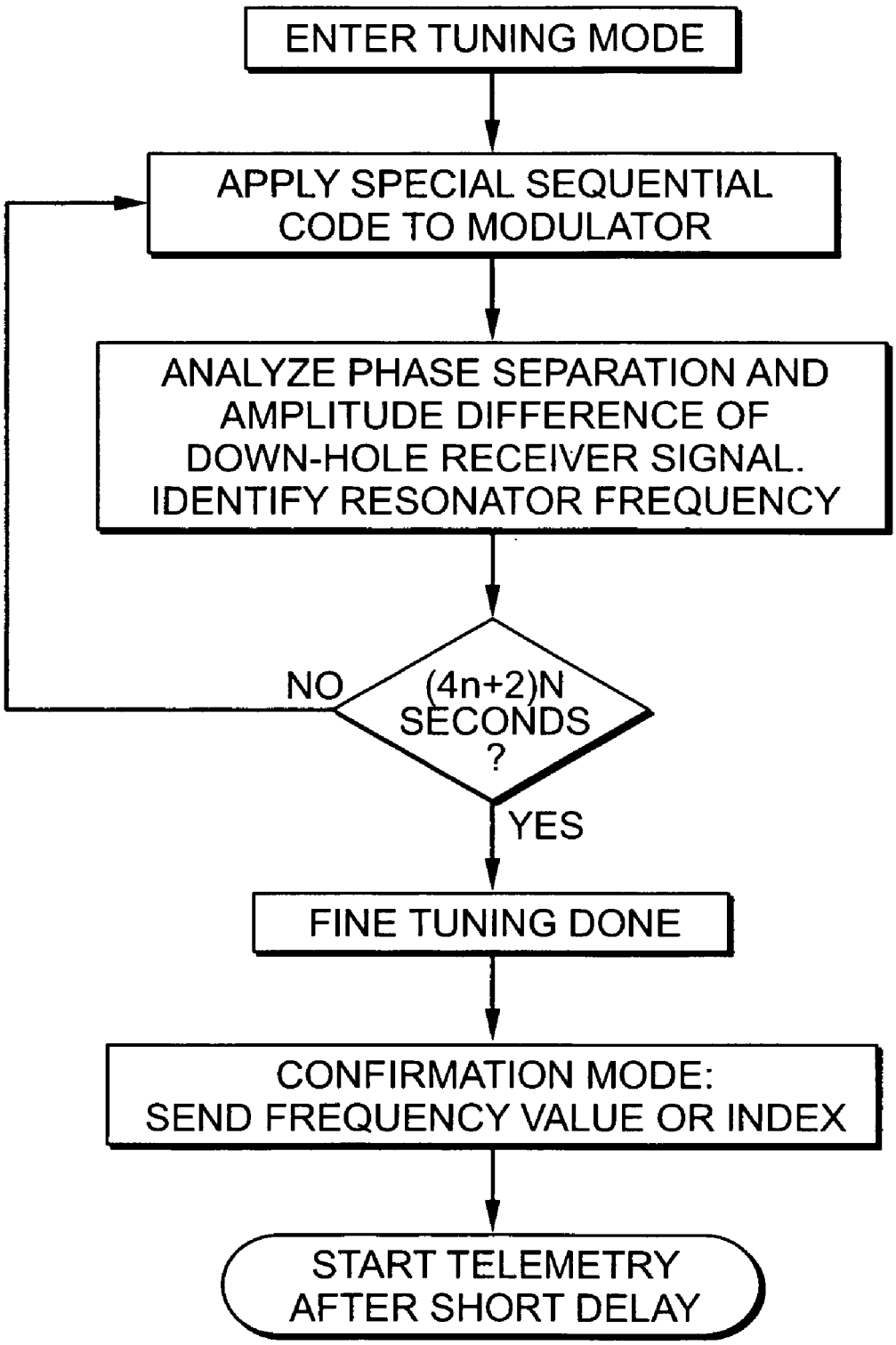

Design tolerances and changes in down-hole conditions such as temperature, pressure may cause mismatch in source and resonator frequencies in practical operations, affecting the quality of modulation. To overcome this, a tuning procedure can be run after the deployment of the tool down-hole and prior to the operation and data transmission. FIGS. 5A,B illustrate the steps of an example of such a tuning procedure, with FIG. 5A detailing the steps performed in the surface units and FIG. 5B those preformed by the down-hole units.

The down-hole modulator is set to a special mode that modulates the reflected wave with a known sequence of digits, e.g. a square wave like sequence. The surface source then generates a number of frequencies in incremental steps, each last a short while, say 10 seconds, covering the possible range of the resonator frequency. The surface signal processing unit analyzes the received phase modulated signal. The frequency at which the maximum difference between digit "1" and digit "0" is achieved is selected as the correct telemetry frequency.

Further fine-tuning may be done by transmitting frequencies in smaller steps around the frequency selected in the first pass, and repeating the process. During such a process, the down-hole pressure can also be recorded through an acoustic down-hole receiver. The frequency that gives maximum difference in down-hole wave phase (and minimum difference in amplitude) between digit state "1" and "0" is the right frequency. This frequency can be sent to the surface in a "confirmation" mode following the initial tunings steps, in which the frequency value, or an index number assigned to such frequency value, is encoded on to the reflected waves and sent to the surface.

The test and tuning procedure may also help to identify characteristics of the telemetry channel and to develop channel equalization algorithm that could be used to filter in the received signals.

The tuning process can be done more efficiently if a down-link is implemented. Thus once it identifies the right frequency, the surface system can inform the down-hole unit to change mode, rather than to continue the stepping through all remaining test frequencies.

A consideration affecting the applicability of the novel telemetry system relates to the power consumption level of the down-hole phase switching device, and the capacity of the battery or energy source that is required to power it.

In a case where the power consumption of an on-off solenoid valve prevents its use in the down-hole phase switching device, an alternative device can be implemented using a piezoelectric stack that converts electrical energy into mechanical displacement.

Figure 6:
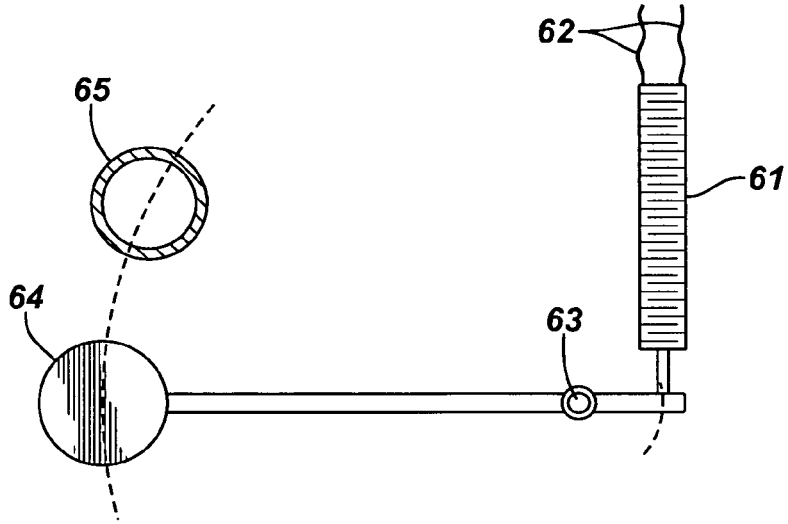
FIG. 6 depicts an element of a telemetry system having low power consumption according to an embodiment of the invention.

In FIG. 6, there is shown a schematic diagram of elements used in a piezoelectrically operated valve. The valve includes stack 61 of piezoelectric discs and wires 62 to apply a driving voltage across the piezoelectric stack. The stack operates an amplification system 63 that converts the elongation of the piezoelectric element into macroscopic motion. The amplification system can be based on mechanical amplification as shown or using a hydraulic amplification as used for example to control fuel injectors for internal combustion engines. The amplification system 63 operates the valve cover 64 so as to shut or open an inlet tube 65. The drive voltage can be controlled by a telemetry unit, such as 163 in FIG. 1.

Though the power consumption of the piezoelectric stack is thought to be lower than for a solenoid system, it remains a function of the data rate and the diameter of the inlet tube, which typically ranges from a few millimeters to a few centimeters.

Additionally, electrical coils or magnets (not shown) may be installed around the inlet tube 65. When energized, they produce an electromagnetic or magnetic force that pulls the valve cover 64 towards the inlet tube 65, and thus ensuring a tight closure of the inlet.

Figure 7A:
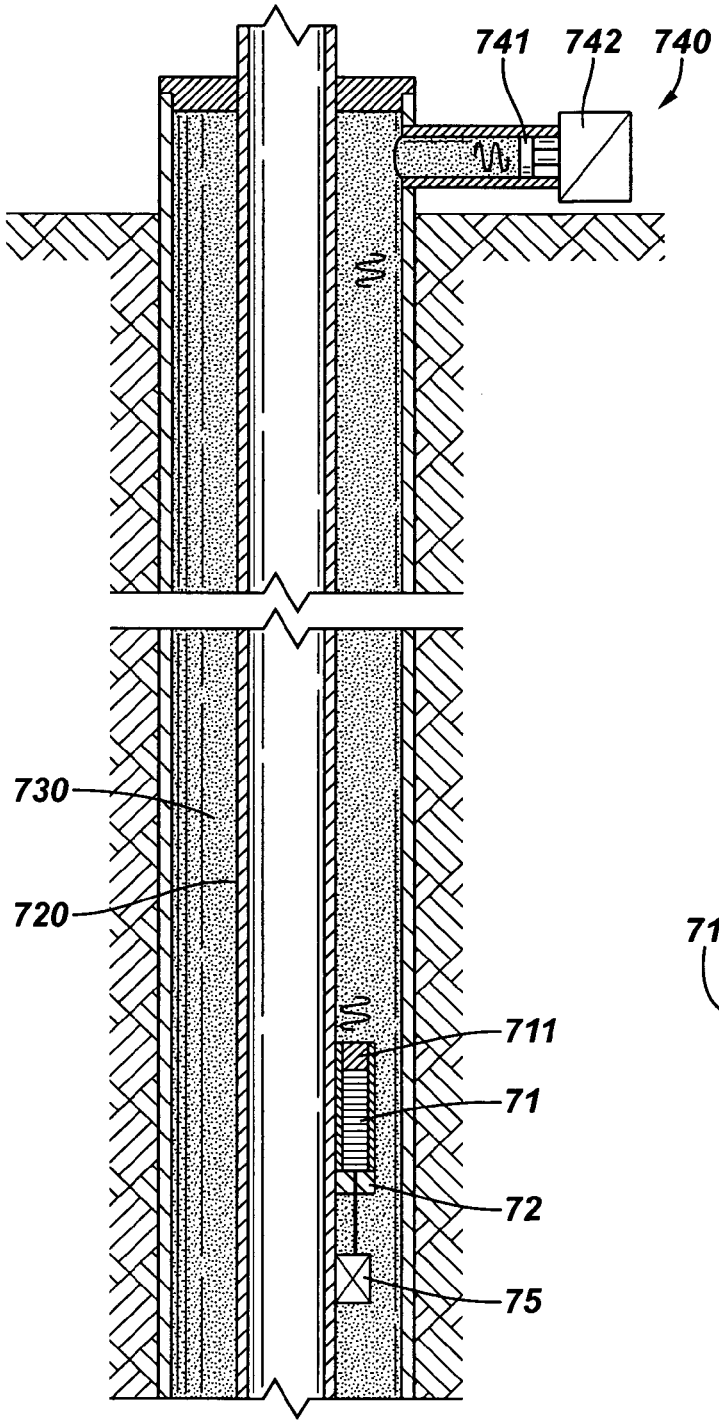

The use of a strong acoustic source on the surface enables an alternative to down-hole batteries as power supply. The surface system can be used to transmit power from surface in the form of acoustic energy and then convert it into electric energy through a down-hole electro-acoustic transducer. In FIGS. 7A,B there is shown a power generator that is designed to extract electric energy from the acoustic source.

A surface power source 740, which operates at a frequency that is significantly different from the telemetry frequency, sends an acoustic wave down the annulus 730. Preferably this power frequency is close to the higher limit of the first pass-band, e.g. 40~60 Hz, or in the $2^{nd}$ or $3^{rd}$ pass-band of the annulus channel, say 120 Hz but preferably below 200 Hz to avoid excessive attenuation. The source can be an electrodynamic or piezoelectric bender type actuator, which generates a displacement of at least a few millimeters at the said frequency. It could be a high stroke rate and low volume piston pump, which is adapted as an acoustic wave source.

In the example of FIG. 7, the electrical to mechanic energy converter 742 drives the linear and harmonic motion of a piston 741, which compresses/de-compresses the liquid in the annulus. The source generates in the annulus 730 an acoustic power level in the region of a kilowatt corresponding to a pressure amplitude of about 100 psi (0.6 MPa). Assuming an attenuation of 10 dB in the acoustic channel, the down-hole pressure at 10 Kft is about 30 psi (0.2 MPa) and the acoustic power delivered to this depth is estimated to be approximately 100 W. Using a transducer with mechanical to electrical conversion efficiency of 0.5, 50 W of electrical power could be extracted continuously at the down-hole location.

Figure 7B:
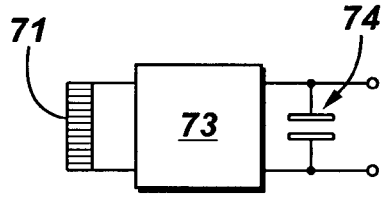
FIG. 7B is a schematic diagram of an element of a down-hole power source of the system of FIG. 7A according to an embodiment of the invention.

As shown in FIG. 7A, the down-hole generator includes a piezoelectric stack 71, similar to the one illustrated in FIG. 6. The stack is attached at its base to a tubing string 720 or any other stationary or quasi-stationary element in the well through a fixing block 72. A pressure change causes a contraction or extension of the stack 71. This creates an alternating voltage across the piezoelectric stack, whose impedance is mainly capacitive. The capacitance is discharged through a rectifier circuit 73 and then is used to charge a large energy storing capacitor 74 as shown in FIG. 7B. The energy stored in the capacitor 74 provides electrical power to down-hole devices such as the gauge sub 75.

The efficiency of the energy conversion process depends on the acoustic impedance match (mechanical stiffness match) between the fluid wave guide 720 and the piezoelectric stack 71. The stiffness of the fluid channel depends on frequency, cross-sectional area and the acoustic impedance of the fluid. The stiffness of the piezoelectric stack 71 depends on a number of factors, including its cross-section (area) to length ratio, electrical load impedance, voltage amplitude across the stack, etc. An impedance match may be facilitated by attaching an additional mass 711 to the piezoelectric stack 71, so that a match is achieved near the resonance frequency of the spring-mass system.

Figure 8:
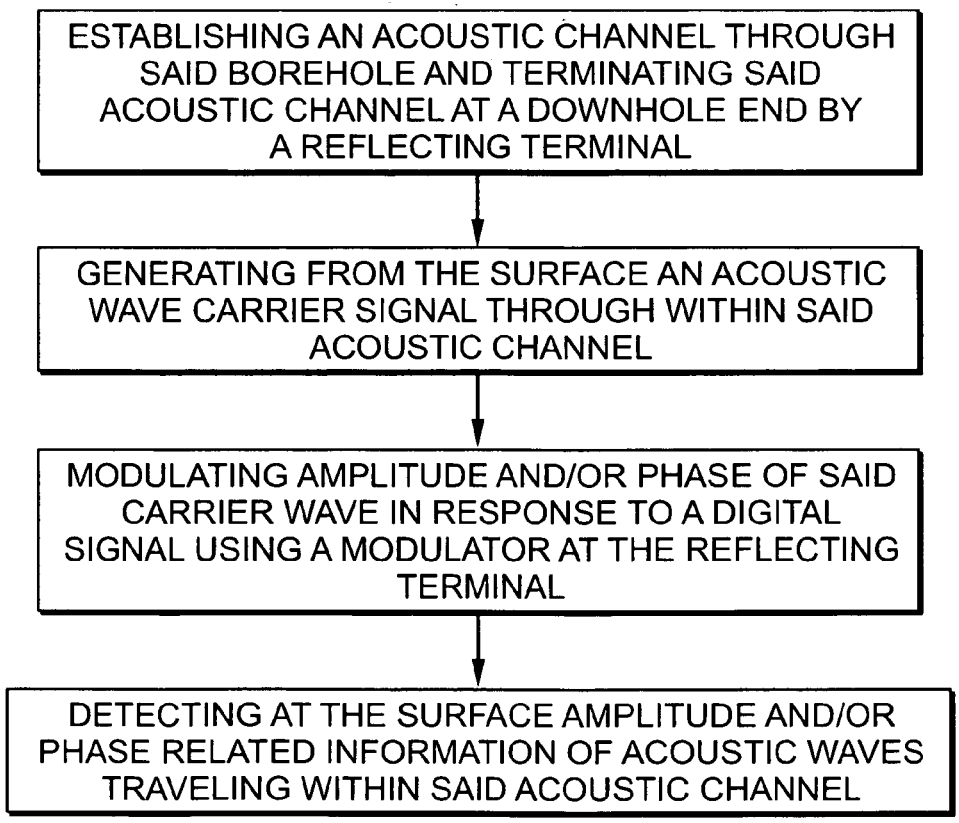
FIG. 8 is a flow diagram depicting a borehole telemetry technique according to an embodiment of the invention.

FIG. 8 summarizes the steps described above.

The above-described borehole telemetry systems may be incorporated into a wide range of downhole applications. For example, referring to FIG. 9, a borehole telemetry system 900 includes a service tool 910 that serves the functions of 1.) setting a hydraulically-set packer 960; 2.) generating stimuli to communicate various pressures related both to this setting and to the seals formed by the packer 960 to the surface of the well; and 3.) receiving commands for the service tool 910 from the surface of the well.

Figure 9:
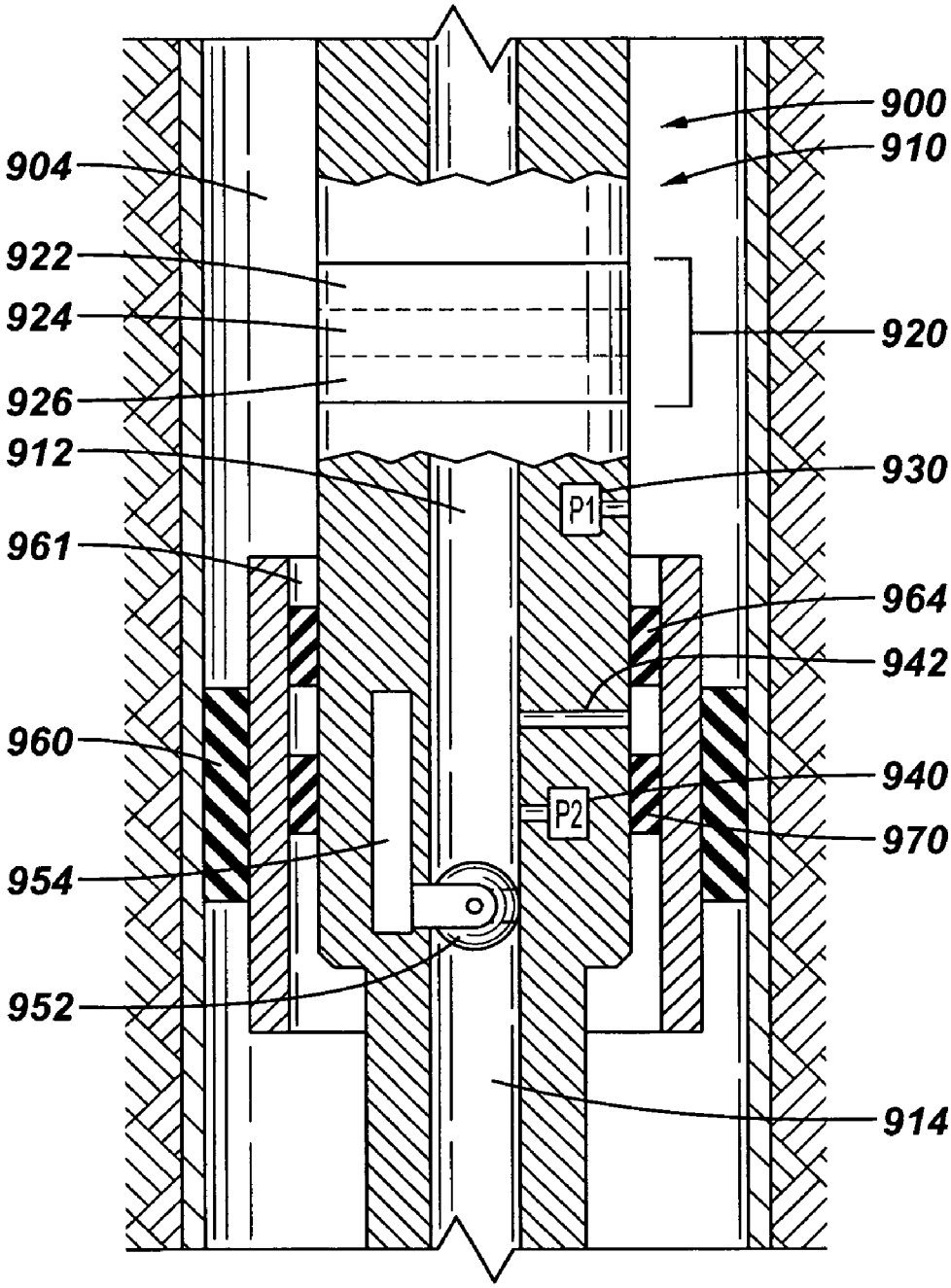
FIG. 9 is a schematic diagram of a borehole telemetry system that includes a packer setting tool according to an embodiment of the invention.

More specifically, in some embodiments of the invention, the service tool 910 may be run downhole on a work string, for example, inside a casing string 902. The packer 960 may also be run downhole with the service tool 910 so that the setting pistons of the packer 960 are in communication with a central passageway 912 of the service tool 910. As depicted in FIG. 9, in some embodiments of the invention, the service tool 910 may include a radial port 942 that establishes fluid communication between the packer 960 and the central passageway 912 to communicate potential packer-setting fluid pressure to the pistons of the packer 960. As also depicted in FIG. 9, in some embodiments of the invention, upper 964 and lower 970 radial seals may form seals between the port 942 and the packer 960.

When the packer 960 is to be set, a command is communicated downhole from the surface of the well to cause a ball valve 952 of the service tool 910 to close, a closure that permits the buildup of fluid pressure to actuate the setting pistons of the packer 960. More specifically, in some embodiments of the invention, the ball valve 952 controls communication between the central passageway 912 above the ball valve 952 and a central passageway 914 of the work string below the valve 952. Thus, when the ball valve 952 closes, a column of fluid is formed above the ball valve 952.

The use of the ball valve 952 replaces the traditional "pumped down ball" and ball seat for purposes of setting the packer.

In some embodiments of the invention, the command to close the ball valve 952 may be communicated to the service tool 910 via stimuli that propagates through fluid present in an annulus 904 of the well, fluid present in the central passageway 912, an acoustic wave present on the work string that conveys the service tool 910 downhole, a wireline, etc., depending on the particular embodiment of the invention. Regardless of the form of the stimuli that is communicated downhole, in some embodiments of the invention, one or more sensors (pressure sensors, acoustic sensors, etc.) of the service tool 910 detect the stimuli so that receiver electronics 926 (of the service tool 910) decodes the transmitted command.

In response to detecting a "close valve" command, the electronics 926 instructs a valve actuator 954 of the service tool 910 to close the ball valve 952. In a similar manner, after the packer 960 is set, another command may be communicated downhole to cause the service tool 910 to open the ball valve 952. Other and different commands may be communicated downhole, in other embodiments of the invention.

Furthermore, in other embodiments of the invention, the operation of the ball valve 952 and possible other downhole tools (such as the packer 960, for example) or equipment may be alternatively controlled through a mechanical intervention (a shifting tool deployed downhole, for example), a control line (a hydraulic, optical or electrical) or other types of wireless communication, such as electromagnetic pulses, for example. It is noted that fluid-type wireless downlink communication is described herein in connection with the downhole telemetry systems. However, it is understood that the above-mentioned alternative mechanisms may be used to control any of the disclosed downhole tools from the surface of the well.

After the ball valve 952 closes, the fluid pressure in the column is increased in the central passageway 912 for purposes of activating the packer pistons and thus, setting the packer 960. Once the packer 960 is set, the sealed annulus 904 is created above the annular seals of the packer 960. The annulus 904 forms a telemetry path for purposes of communicating measurements and state information uphole, in some embodiments of the invention.

More specifically, in some embodiments of the invention, the electronics 926 may be part of a data and telemetry sub 920, a component of the service tool 910, which receives and decodes commands that are transmitted downhole, performs various downhole measurements and communicates stimuli indicative of the measurements uphole.

In some embodiments of the invention, the data and telemetry sub 920 may include transmitter electronics 922 that receives various signals (analog and/or digital signals, for example) from the various sensors of the service tool 910 and forms corresponding digital signals that form a digital sequence for driving a valve 924 for purposes of forming a resonant modulator (a Helmholtz modulator, for example), as described above. Thus, as described above, phase modulation may be used for purposes of modulating a carrier stimulus that is communicated from the surface of the well so that the resultant wave that is detected at the surface of the well indicates one or more downhole measurements. These measurements, in turn, allow an operator to understand the downhole process, and based on this understanding, instructions may be formulated and converted into commands that are communication from the surface of the well to the service tool 910.

As a more specific example of the measurements that are performed by the service tool 910, in some embodiments of the invention, the service tool 910 may include a pressure sensor 930 that measures a pressure in the annulus 904. This pressure measurement may be useful to, for example, determine the integrity of the annulus seal that is formed by the packer 960 when set. Furthermore, the service tool 910 may include another pressure sensor 940 that is in communication with the central passageway 912 for purposes of monitoring work string pressure during a packer setting operation (for example) and any other possible subsequent treatment operations. Thus, in some embodiments of the invention, a pressure level may be sensed by the sensor 940 during the setting the packer 960 and communicated uphole, thereby providing an indication of whether sufficient pressure was or is being provided to the packer 960 to set the packer.

In connection with this same setting operation, pressure sensor 930 may provide a measurement that indicates that the packer was successfully set, in that the annulus pressure that is sensed by the sensor 930 indicates whether a sufficient annular seal was formed by the packer 960. Many other variations are possible and are within the scope of the appended claims.

For example, although the annulus 904 may be used for purposes of communicating measurements uphole, in other embodiments of the invention, the central passageway 912 of the work string alternatively may be used as a telemetry path for purposes of communicating measurements uphole.

Figure 10:
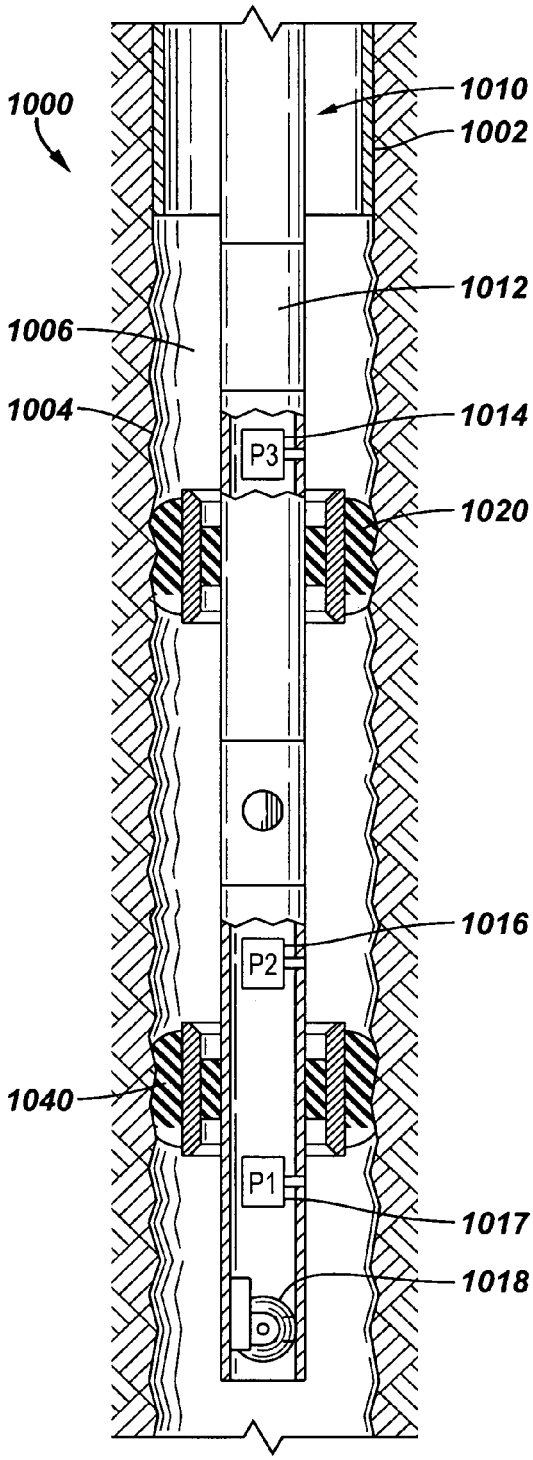
FIGS. 10 and 11 are schematic diagrams of borehole telemetry systems that include tools to set zonal isolation devices according to different embodiment of the invention.

Referring to FIG. 10, in another embodiment of the invention, a zonal isolation string 1010 may be used to establish a borehole telemetry system 1000. The string 1010 includes a data and telemetry sub 1012 similar in design to the data and telemetry sub 920 (see FIG. 9). Thus, the sub 1012 may receive commands that are communicated from the surface of the well, as well as perform modulation of a carrier stimuli for purposes of communicating measurements uphole. The string 1010 includes upper 1020 and lower 1040 packers that are run downhole as part of the string 1010.

The packers 1020 and 1040 are set for purposes of establishing an isolated zone between the packers 1020 and 1040. As depicted in FIG. 10, in some embodiments of the invention, the packers 1020 and 1040 are run into an uncased wellbore 1004. The uncased wellbore 1004 may be an extension of a wellbore that extends from a cased portion (depicted by reference numeral 1002) of the wellbore, in some embodiments of the invention.

Similar to the general operation of the service tool 910 (see FIG. 9), the packers 1020 and 1040 are hydraulically set, in some embodiments of the invention. More specifically, for purposes of setting the packers 1020 and 1040, in some embodiments of the invention, the string 1010 includes a ball valve and actuator assembly 1018. The assembly 1018 is located below the lower packer 1040 for purposes of selectively sealing off the central passageway of the string 1010. Thus, when the ball valve of the assembly 1018 is closed, the pressure inside the central passageway may be increased for purposes of setting the packers 1020 and 1040. After the packers 1020 and 1040 have been set, the ball valve is then opened to allow communication through the central passageway.

In some embodiments of the invention, the string 1010 includes various sensors that take downhole measurements so that the data and telemetry sub 1012 may communicate these measurements (via the above-described modulation) uphole. For example, in some embodiments of the invention, the string 1010 includes a pressure sensor 1017 that is located below the lower packer 1040 to measure the pressure below the isolated zone. The sensors may also include a pressure sensor 1016 that is located between the packers 1020 and 1040 to measure the pressure inside the isolated zone. In some embodiments of the invention, the string 1010 may also include a pressure sensor 1014 that is located above the upper packer 1020 for purposes of measuring the pressure above the isolated zone. The use of the multiple pressure sensors may be very helpful in finding leaks in zonal isolation devices.

Figure 11:
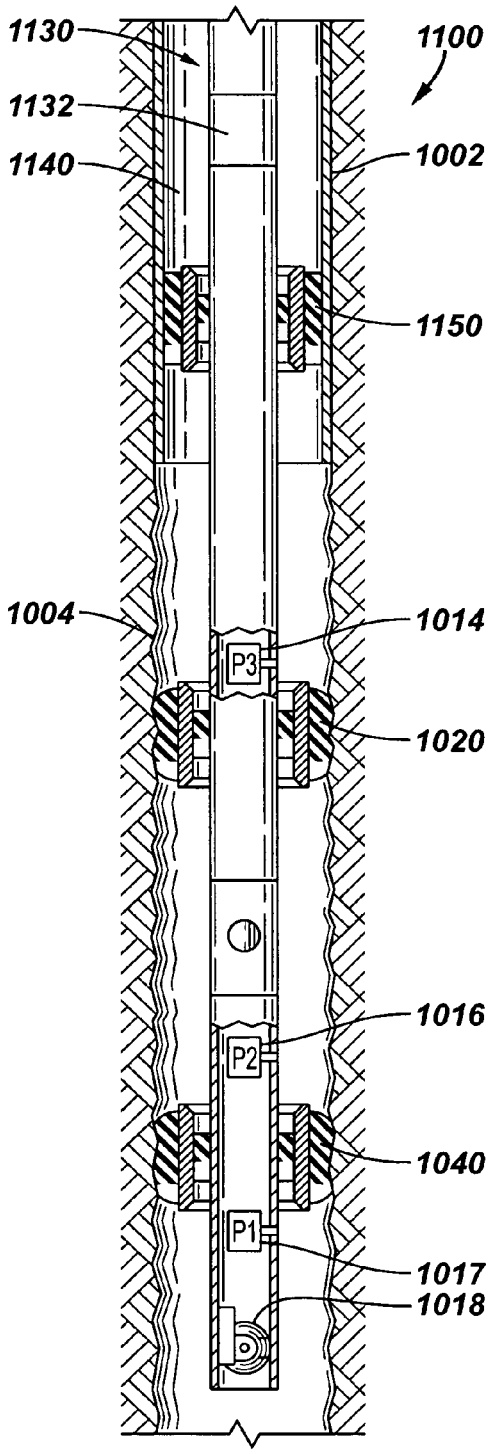

In the borehole telemetry system 1000, communication uphole to the surface occurs via an annulus 1006 that surrounds the work string 1010 and forms a telemetry path. However, other telemetry communication paths may exist in other embodiments of the invention. For example, referring to FIG. 11, in another embodiment of the invention, a borehole telemetry system 1100 may be used.

In the borehole telemetry system 1100, a work string 1130 is used instead of the work string 1010 (see FIG. 10). The work string 1130 is similar in design to the work string 1010 (with like reference numerals being used to indicate common features) with the following differences. In particular, the work string 1130 uses an annulus 1140 that is sealed off from an annulus that extends into the borehole 1004. Thus, cabling (for example) extends between the sensors 1014, 1016 and 1018 through the work string 1130 and to a data and telemetry sub 1132 (replacing the data and telemetry sub 1012) of the work string 1130.

The location of the data and telemetry sub 1132 uphole from the data sub 1012 (see FIG. 10) is necessary due to a polished bore receptacle or bonded seal assembly 1150 that forms a seal between the casing section 1002 of the well and the outer surface of the work string 1130. Therefore, the data and telemetry sub 1132 is located above the assembly 1150 so that the annulus 1140 above the assembly 1150 may be used for purposes of uphole communication. Other variations are possible and are within the scope of the appended claims.

Figure 12:
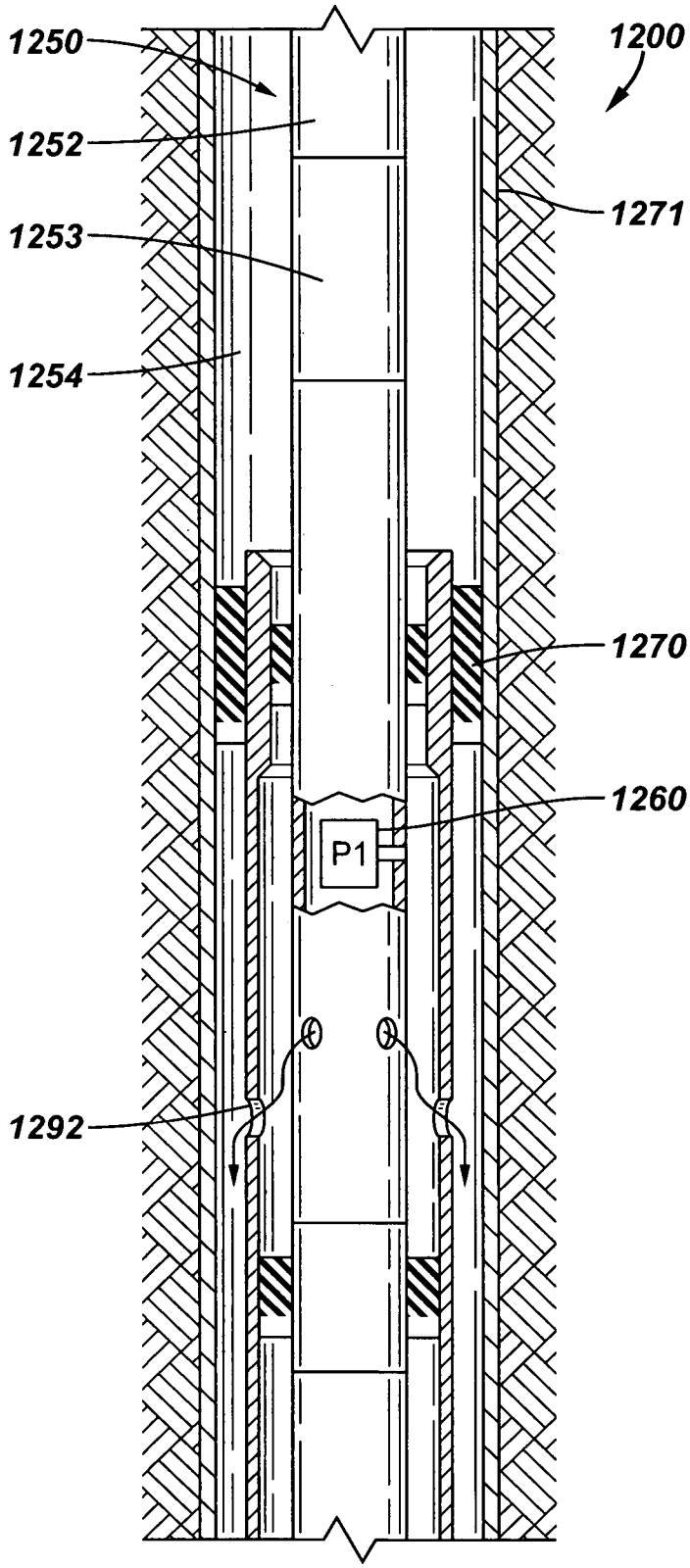
FIG. 12 is a schematic diagram of a borehole telemetry system that includes a gravel packing tool according to an embodiment of the invention.

Referring to FIG. 12, in another embodiment of the invention, a borehole telemetry system 1200 is formed from a work string 1250 that is used in the gravel packing of a sand control completion. More specifically, the work string 1250 extends inside a casing string 1271 and through a passageway of a packer 1270 (that seals off an annulus 1254 of the well when set) and into a region of the well in which gravel packing is to occur. A gravel-packing slurry flow travels through a central passageway 1252 of the work string 1250 (from the surface of the well) and into radial ports 1292 of the string 1250. The slurry flow flows from the radial ports 1292 into an annulus 1293 (below the packer 1270) that surrounds the string 1250 in which gravel packing is to occur.

Above the packer 1270, the annulus 1254 is formed when the packer 1270 is set; and the annulus 1254 forms a telemetry path for purposes of communicating measurements uphole. In this regard, in some embodiments of the invention, the work string 1250 includes a data and telemetry sub 1253 that is surrounded by the annulus 1254. The data and telemetry sub 1253 has a similar design to the data and telemetry subs that are described for the borehole telemetry systems 900, 1000 and 1100.

As an example of one of the potential sensors of the string 1250, in some embodiments of the invention, the string 1250 includes a pressure sensor 1260 that is located near the radial ports 1292 for purposes of measuring a pressure of the slurry flow at the point where the slurry flow leaves the radial ports 1292. As in the other strings, commands may be communicated downhole to open or close a valve to shift the tool state without string movement. Thus, many variations are possible and are within the scope of the appended claims.

Figure 13:
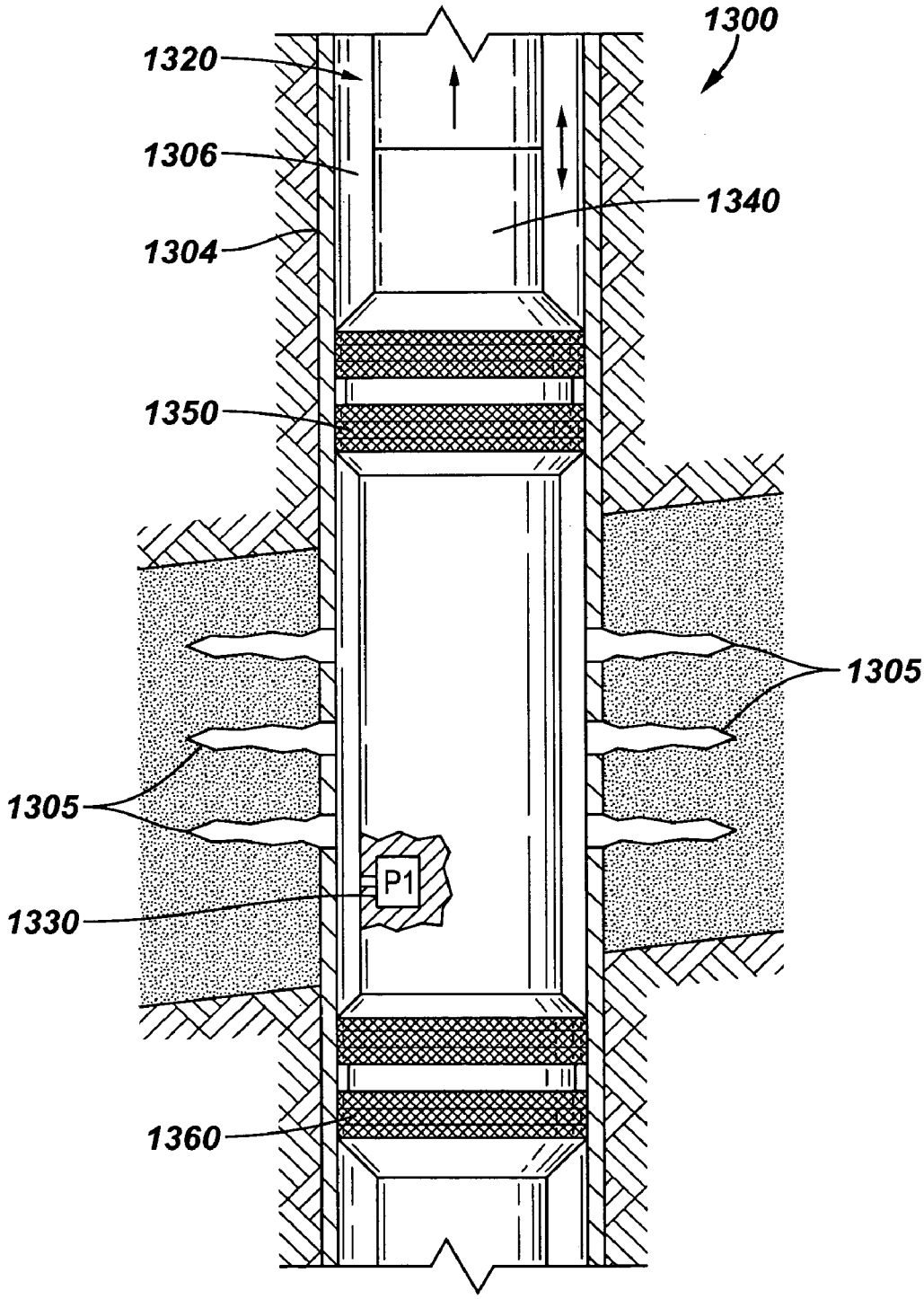
FIG. 13 is a schematic diagram of a borehole telemetry system that includes a straddle packer assembly according to an embodiment of the invention.

Referring to FIG. 13, in another borehole telemetry system 1300, a string 1320 includes an upper packer 1350 and a lower packer 1360. This arrangement may be useful for purposes of testing a wellbore interval by letting well fluid flow (through perforations 1305 in a casing string 1304, for example) into a zone between the upper 1350 and the lower 1360 packer assemblies and flowing the produced fluid to the surface via a central passageway of the string 1320. As an example, the string 1320 may be a drill pipe, in some embodiments of the invention.

In some embodiments of the invention, the string 1320 includes a pressure sensor 1330 that is located between the upper 1350 and lower 1360 seals (packers or non-energized downhole seals (such as bonded seals), as just a few examples) to record the pressure of a zone that is being produced. The pressure sensor 1330 is electrically connected to a data and telemetry sub 1340 that communicates via an annulus 1306 (above the upper seal 1350) to the surface of the well.

In some embodiments of the invention, the data and telemetry sub 1340 may use the pressure sensor 1330 to record pressure at a higher frequency (i.e., more samples than can be transmitted over the annulus telemetry path 1306 in real time. Therefore, in some embodiments of the invention, the data that is collected from the pressure sensor 1330 may be stored for transmission over a longer period of time. The preciseness afforded by the large number of measurements may be helpful in deriving exact pressure signatures during shut-in and help bring the interval on production.

In some embodiments of the invention, various commands may be communicated downhole, such as, for example, commands related to setting the seals 1350 and 1360, for embodiments of the invention in which the seals are energized seals. Furthermore, in some embodiments of the invention, commands may be communicated downhole to program the data and telemetry sub 1340 so that the sub 1340 records pressure spikes when triggered by a shut-in and/or draw-down condition.

Figure 14:
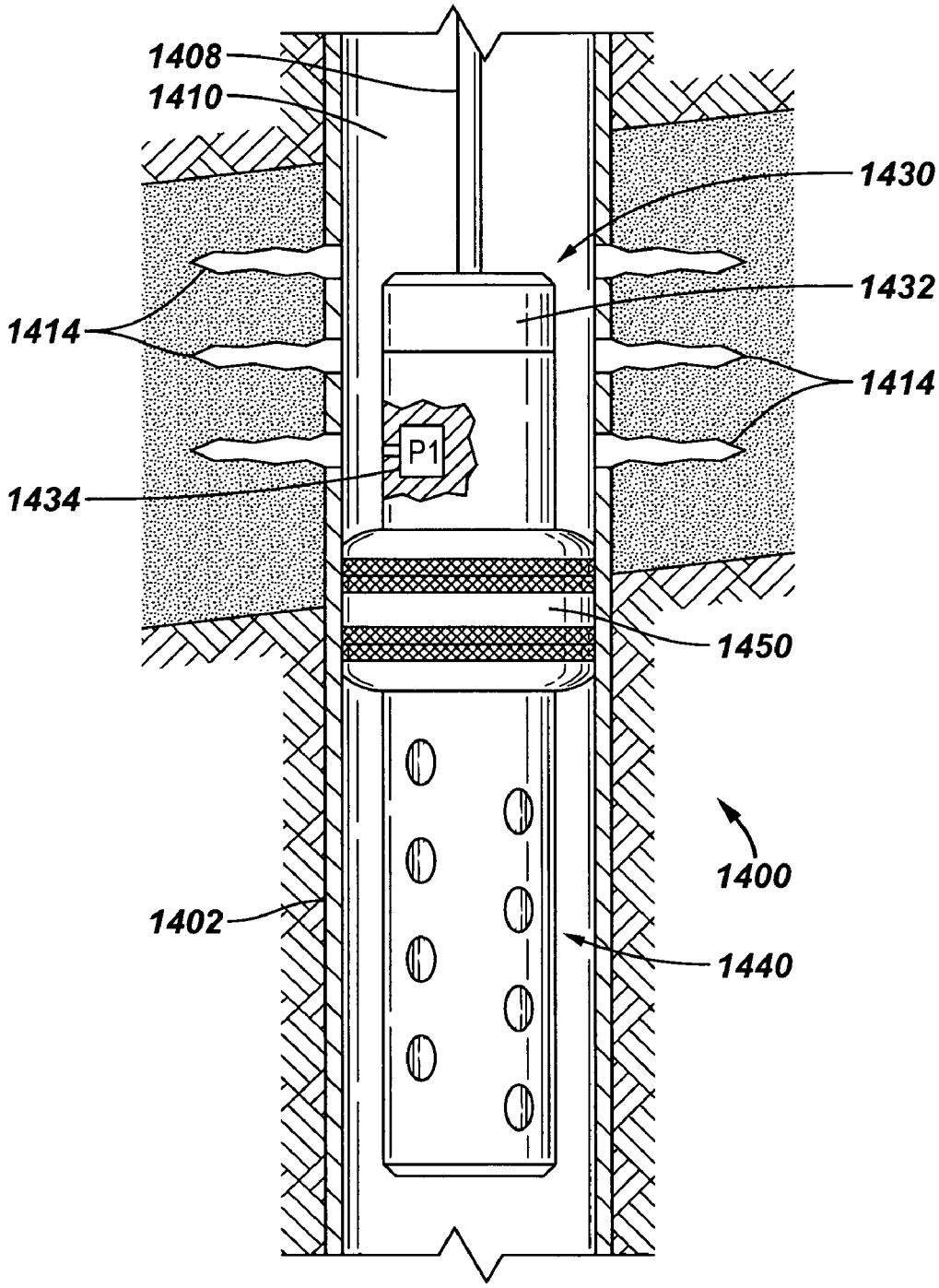
FIG. 14 is a schematic diagram of a borehole telemetry system that includes a single trip perforation and fracturing service tool according to an embodiment of the invention.

In other embodiments of the invention, a borehole telemetry system 1400 that is depicted in FIG. 14 may be used. The system 1400 includes a single-trip perforating and fracturing service tool 1430 that may be lowered downhole via a coiled tubing string 1408, for example. As its name implies, the tool 1430 includes a perforating gun 1440 for purposes of forming casing and formation perforations, such as the depicted casing perforations 1414. The tool 1430 may also include, in some embodiments of the invention, an inflatable packer 1450 that is inflated for purposes of forming an annular seal between the interior surface of the casing string 1402 and the tool 1430. Alternatively, in other embodiments of the invention, the inflatable packer 1450 may be replaced by another sealing element, such as a set-down or a compression packer, as just a few examples.

The setting of the packer 1450 permits various tests to be performed by the tool 1430. For example, as depicted in the exemplary state of the tool 1430 shown in FIG. 14, the packer 1450 may be inflated so that a pressure (measured by a pressure sensor 1434) above the packer 1450 may be measured. A data and telemetry sub 1432 (of the tool 1430) communicates the pressure that is measured from the pressure sensor 1434 uphole by modulating a carrier stimulus, as described above. The telemetry path for this communication may be by way of an annulus 1410.

Another pressure sensor 1435 of the tool 1430 may be used for purposes of determining an exact pressure while pumping a fracture treatment as well as determining a pressure signature while the fracture is flowing back after the pumping of the fracture treatment. As depicted in FIG. 14, the pressure sensor 1435 may be located below the packer/sealing element 1450 and in communication either with an internal passageway of the tool 1430 or in communication with an annulus 1401, depending on the particular embodiment of the invention.

In some embodiments of the invention, the pressure sensor 1434 may be used for purposes of decoding commands that are communicated downhole (via the annulus 1410) for purposes of instructing the tool 1430 to perform some downhole function, such as selectively firing the perforating gun 1440, for example.

Figure 15:
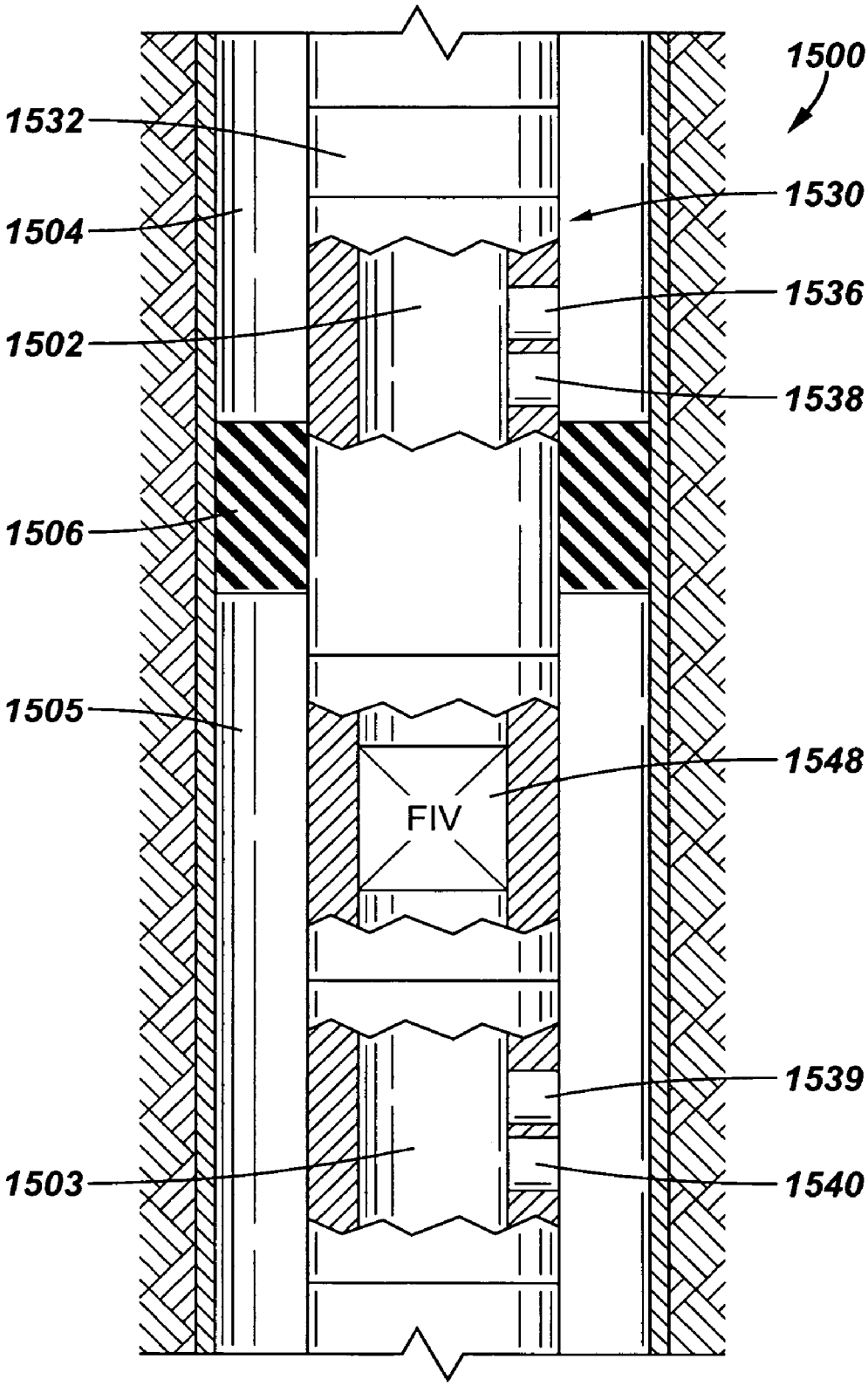
FIG. 15 is a schematic diagram of a borehole telemetry system that includes a formation isolation valve according to an embodiment of the invention.

Referring to FIG. 15, in some embodiments of the invention, a borehole telemetry system 1500 may be used. The borehole telemetry system 1500 includes a formation isolation valve assembly 1530 that includes a formation isolation valve 1548 to, as its name implies, selectively isolate a region of the formation. As depicted in FIG. 15, in some embodiments of the invention, the formation isolation valve 1548 is located to selectively isolate an upper central passageway 1502 of the assembly 1530 from a lower central passageway 1503 of the assembly 1530. A packer 1506 is set to form an annular seal between the exterior of the formation valve assembly 1530 and an interior wall of a surrounding casing string 1504. Thus, when the formation isolation valve 1548 is closed, the region below the formation isolation valve 1548 of the well is isolated from the region of the well above the formation isolation valve 1548.

In some embodiments of the invention, the formation isolation valve assembly 1530 includes a data and telemetry sub 1532 of similar design to the data and telemetry subs that are described above. In particular, in some embodiments of the invention, the data and telemetry sub 1532 may use an annulus 1504 (located above the packer 1506) to communicate measurements uphole via modulation of a carrier stimulus. Furthermore, the data and telemetry sub 1532 may receive commands either transmitted through the central passageway 1502 or through the annulus 1504.

In some embodiments of the invention, the formation isolation valve assembly 1530 includes a pressure sensor 1536 for purposes of measuring a pressure inside the central passageway 1502 and a pressure sensor 1538 for purposes of measuring a pressure in the annulus 1504. Thus, the pressure sensors 1536 and 1538 are used for measuring pressures above the formation isolation valve 1548. The formation isolation valve assembly 1530 may also include, for example, a pressure sensor 1539 for purposes of measuring a pressure inside the central passageway 1503 below the formation isolation valve 1548; and the formation isolation valve assembly 1530 may include a pressure sensor 1540 for purposes of measuring the pressure in an annulus 1505 located below the packer 1506. Thus, the pressure sensors 1539 and 1540 may be used for purposes of measuring pressures below the formation valve 1548.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable in a well, comprising:

performing a downhole measurement; and communicating the downhole measurement uphole, the communicating comprising at a first location in the well, modulating a carrier stimulus communicated through a downhole fluid from a second location in the well to the first location.

2. The method of claim 1, wherein the downhole measurement comprises a measurement indicative of a change in state of a downhole tool.

3. The method of claim 1, wherein the act of modulating is used to confirm operation of a downhole tool.

4. The method of claim 1, further comprising:

receiving a second stimulus at the surface of the well indicative of the measurement.

5. The method of claim 1, wherein the act of performing occurs in response to setting a packer.

6. The method of claim 5, wherein the measurement indicates an integrity of an annulus seal formed by the packer when set.

7. The method of claim 5, wherein the measurement comprises a pressure of a fluid through which pressure is communicated to set the packer.

8. The method of claim 5, further comprising:

forming a sealed annulus in response to setting the packer and using the annulus to communicate the second stimulus.

9. The method of claim 1, wherein the act of performing occurs in response to setting a zone isolation tool.

10. The method of claim 9, wherein the measurement comprises a pressure inside an isolated zone established by the zone isolation tool.

11. The method of claim 9, wherein the measurement comprises a pressure below an isolated zone established by the zone isolation tool.

12. The method of claim 9, wherein the measurement comprises a pressure above an isolated zone established by the zone isolation tool.

13. The method of claim 1, wherein the act of performing occurs in response to a gravel packing operation.

14. The method of claim 13, wherein the measurement comprises a pressure of a slurry flow near a slurry exit port of a gravel packing tool where the slurry flow exits the tool and enters an annulus of the well.

15. The method of claim 13, further comprising:

communicating a wireless stimulus downhole to change a state of a gravel packing tool.

16. The method of claim 1, wherein the act of performing comprises setting a seal assembly to isolate a zone and the measurement comprises a pressure in the zone.

17. The method of claim 16, wherein the modulating generates a second stimulus that indicates the measurement and is generated over a first time interval that has a substantially longer duration than a second time interval over which the downhole measurement occurs.

18. The method of claim 16, further comprising:

triggering the measurement in response to a predetermined pressure level caused by at least one of a shut-in condition and a draw-down condition.

19. The method of claim 1, wherein the act of performing comprises:

measuring a pressure associated with a fracturing operation.

20. The method of claim 19, wherein the pressure comprises a pressure of fracturing fluid during pumping of the fracturing fluid.

21. The method of claim 19, wherein the pressure comprises a pressure of fracturing fluid during flowback of the fracturing fluid after pumping of the fracturing fluid.

22. The method of claim 1, wherein the measurement comprises a pressure near a permanently mounted formation isolation valve.

23. The method of claim 22, wherein the pressure comprises a pressure below the valve in an area of the well sealed off by the valve.

24. The method of claim 22, wherein the pressure comprises a pressure above the valve in a region of the well isolated from the region by the valve.

25. A system usable with a well, comprising:

an assembly to perform a downhole measurement; and a downhole telemetry tool at a first location and connected to the assembly to:

receive a carrier stimulus communicated from a second location in the well through a downhole fluid to the first location, and modulate the carrier stimulus to communicate the measurement uphole.

26. The system of claim 25, wherein the downhole measurement comprises a measurement indicative of a change in a state of the assembly.

27. The system of claim 25, wherein the telemetry tool generates the second stimulus to confirm operation of the assembly.

28. The system of claim 25, wherein the telemetry tool generates a second stimulus that is received at the surface of the well and indicates the measurement.

29. The system of claim 25, wherein the assembly comprises a packer.

30. The system of claim 29, wherein the measurement indicates an integrity of an annulus seal formed by the packer.

31. The system of claim 29, wherein the packer is adapted to be set in response to a pressure of a fluid and the measurement is indicative of the pressure.

32. The system of claim 29, wherein setting of the packer creates a sealed annulus in which the assembly generates the second stimulus.

33. The system of claim 25, wherein the assembly comprises a zone isolation tool adapted to establish an isolated zone downhole in the well.

34. The system of claim 33, wherein the measurement comprises a pressure inside the isolated zone.

35. The system of claim 33, wherein the measurement comprises a pressure below the isolated zone.

36. The system of claim 33, wherein the measurement comprises a pressure above the isolated zone.

37. The system of claim 25, wherein the assembly comprises a gravel packing tool.

38. The system of claim 37, wherein the gravel packing tool comprises an exit port to communicate a slurry flow inside an annulus of the well and a sensor to measure a pressure of the slurry flow near the exit port.

39. The system of claim 37, wherein the gravel packing tool is adapted to change a state in response to a wireless stimulus communicated downhole from the surface of the well.

40. The system of claim 25, wherein the assembly comprises a straddle packer assembly to isolate a zone in the well.

41. The system of claim 40, wherein the measurement is indicated by a second stimulus and the second stimulus is generated over a first time interval that has a substantially longer duration than a second time interval over which the assembly performs the downhole measurement.

42. The system of claim 40, wherein the assembly is adapted to trigger the measurement in response to a predetermined pressure level caused by at least one a shut-in condition and a draw-down condition in the zone.

43. The system of claim 25, wherein the assembly comprises a tool to communicate a fracturing fluid into the well.

44. The system of claim 43, wherein the assembly comprises a sensor to measure a pressure of fracturing fluid during pumping of the fracturing fluid through the tool.

45. The system of claim 43, wherein the assembly comprises a sensor to measure a pressure of fracturing fluid during flowback of the fracturing fluid after pumping of the fracturing fluid through the tool.

46. The system of claim 43, wherein the assembly further includes a perforating gun.

47. The system of claim 25, wherein the assembly comprises a permanently mounted formation isolation valve.

48. The system of claim 47, wherein the assembly comprises a sensor to measure a pressure below the valve in an area of the well sealed off by the valve.

49. The system of claim 47, wherein the assembly comprises a sensor to measure a pressure in a region above the valve and isolated by the valve from a formation below the valve.

50. The method of claim 1, wherein the second location comprises a location at the surface of the well and the first location comprises a location downhole in the well.

51. The method of claim 25, wherein the second location comprises a location at the surface of the well and the first location comprises a location downhole in the well.

* * * * *